US007459662B1

(12) United States Patent
Gardner

(10) Patent No.: US 7,459,662 B1
(45) Date of Patent: Dec. 2, 2008

(54) PHOTOMULTIPLIER TUBE CIRCUIT INCLUDING MEANS FOR SAMPLING THE VOLTAGE OF AT LEAST ONE DYNODE

(75) Inventor: John Gardner, Aldermaston (GB)

(73) Assignee: The Secretary of State or Defense, London (GB)

( * ) Notice: Subject to any disclaimer, the term of this patent is extended or adjusted under 35 U.S.C. 154(b) by 0 days.

(21) Appl. No.: 09/806,007

(22) PCT Filed: Sep. 17, 1999

(86) PCT No.: PCT/GB99/03090

§ 371 (c)(1),
(2), (4) Date: Mar. 26, 2001

(87) PCT Pub. No.: WO00/21115

PCT Pub. Date: Apr. 13, 2000

(30) Foreign Application Priority Data

Oct. 2, 1998 (GB) ..... 9821359.8

(51) Int. Cl.
*H01J 40/14* (2006.01)

(52) U.S. Cl. ..... 250/207; 250/214 VT

(58) Field of Classification Search ..... 250/207, 250/214 VT, 214.1, 310, 311; 313/532, 533, 313/103 R, 105 CM
See application file for complete search history.

(56) References Cited

U.S. PATENT DOCUMENTS

| | | | | |
|---|---|---|---|---|
| 3,694,659 | A | 9/1972 | Ramsay et al. | |
| 3,997,779 | A | 12/1976 | Rabl | |
| 4,436,994 | A | 3/1984 | Van Vliet et al. | |
| 7,030,355 | B1 * | 4/2006 | Bochenski et al. | 250/207 |

FOREIGN PATENT DOCUMENTS

| | | |
|---|---|---|
| FR | 2 213 585 | 8/1974 |
| FR | 2 672 996 | 8/1992 |
| GB | 2 190 785 | 11/1987 |

* cited by examiner

*Primary Examiner*—Que T Le
(74) *Attorney, Agent, or Firm*—Nixon & Vanderhye P.C.

(57) ABSTRACT

A photomultiplier tube circuit with reduced power consumption comprising a photomultiplier tube having a plurality of dynodes, charging circuitry for providing charge to the plurality of dynodes and an oscillator for providing a high voltage supply to the charging circuitry characterised in that the photomultiplier tube circuit further comprises means for sampling the voltage of at least one of the dynodes and a switching means for switching the oscillator on and off with respect to the at least one dynode voltage sampled.

16 Claims, 1 Drawing Sheet

Figure
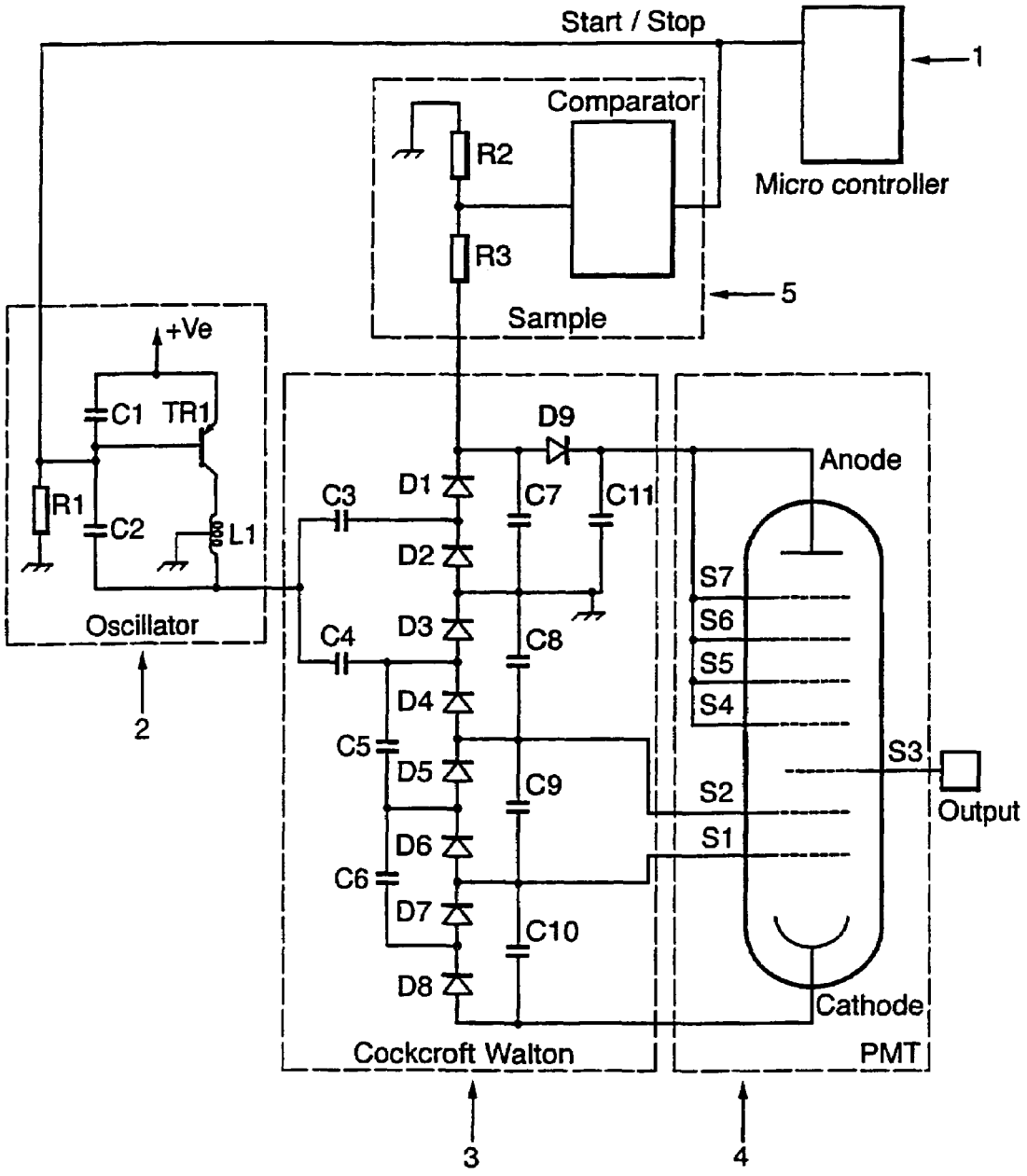

PHOTOMULTIPLIER TUBE CIRCUIT INCLUDING MEANS FOR SAMPLING THE VOLTAGE OF AT LEAST ONE DYNODE

This application is the U.S. national phase of international application PCT/GB99/03090, filed in English on Sep. 17, 1999 which designated the U.S. PCT/GB99/03090 claims priority to GB Application No. 9821359.8 filed Oct. 2, 1998. The entire contents of these applications are incorporated herein by reference.

The present invention relates to an improved circuit for charging and controlling a photomultiplier tube (PMT) and in particular to a circuit used to enable a monitoring device to gain BASEEFA (British Approval Services for Electrical Equipment for use in Flammable Atmospheres) certification, meaning that it is designated safe for use in an explosive environment.

Known PMTs comprise a photocathode, a plurality of multiplication dynodes having an associated voltage divider network and an anode. The dynodes of the PMT require a progressively higher voltage to ensure the transmission of secondary electrons through the multiplier section of the tube. Usually the voltage supply is provided by a resistive voltage divider network. A stabilised high voltage power supply is therefore required. To prevent excessive variations in the dynode voltages, the current through the voltage divider network should be high compared with the electrode currents themselves. A minimum value of at least 100 times the maximum average anode current is required. Typically, the PMT has ten dynode stages which are supplied with the particular voltage necessary to obtain the required overall gain.

Alternatively the dynode stages can be supplied by a Cockcroft Walton arrangement which is known to be an efficient means for charging the dynodes. Such an arrangement has a capacitor circuit associated with each of the dynode stages. The capacitor circuit stores the necessary charge to maintain the voltage required at each of the dynode stages to ensure linearity of response for the largest pulse events likely. Such an arrangement provides a low current supply to the dynodes which helps to reduce the power consumption of the circuit.

The Oscillator which supplies the HV to the circuit provides the majority of the losses in such a circuit and as such any reduction in the time for which the Oscillator is required to be on will provide the best return as far as power efficiency is concerned.

Furthermore, known PMTs are prone to damage if they are exposed to light, for example when the screen on a monitor is punctured. This is due to the amplification of the input signal by the multiplying dynodes which overloads the PMT by stripping the coating from the electrodes by secondary electron emission. This "stripping" effect occurs during normal operation of the PMT although somewhat slower and controlled, giving a finite life to any PMT.

In order to improve the power efficiency of the PMT/HV circuitry the inventor has found that the oscillator does not require to provide a continuous supply and can be switched on and off without effecting the signal produced by the PMT. By sampling the voltage on one of the dynode stages the oscillator can be controlled such that when the voltage on a dynode stage drops below a predetermined level the oscillator will be switched on thus restoring the required voltage. When the voltage is back up to the required level the oscillator can be switched off.

It is an aim of the present invention to provide a PMT circuit which reduces the power consumption of the circuit and additionally meets the BASEEFA requirements.

Accordingly, the present invention provides a photomultiplier tube circuit comprising a photomultiplier tube having a plurality of dynodes, charging circuitry for providing charge to the plurality of dynodes and an oscillator for providing a high voltage supply to the charging circuitry characterised in that the photomultiplier tube circuit further comprise means for sampling the voltage of at least one of the dynodes and a switching means for switching the oscillator on and off with respect to the at least one dynode voltage sampled.

In the PMT and associated HV circuitry according to the invention, the preferred/enhanced operating conditions for a given voltage is determined. Each dynode stage can then be supplied with the optimum voltage by conventional charging circuitry or preferably by using a Cockcroft Walton arrangement. By maintaining each dynode at the optimum voltage, space charge effects and non-linearity are reduced. The number of dynode stages used determines the overall gain which will be achieved. The overall gain is kept to a minimum consistent with signal to noise requirements, keeping peak and average currents low and extending PMT life. Any unused stages on a PMT can be linked to the anode. The system provides a low impedance HV supply for each dynode, as required, providing just sufficient charge to ensure linearity of response for the largest pulse events likely.

The amount of charge is closely controlled to increase the power efficiency of the circuit and the switching means is configured to switch the oscillator on and off in response to the dynode voltage sampled so as to maintain the required operating conditions.

Advantageously the switching means can be in the form of a micro-controller and can usefully be configured so as to determine the length of time the oscillator is switched on for in order to maintain the required operating conditions. This 'on' time period can be used to determine the exposure condition of the PMT and enable the switching means to prevent dynode, anode or photo-cathode damage (such as "stripping"). It can also reduce power wastage due to currents caused by exposure conditions outside the normal operating range of the equipment, such as excessive light conditions caused by foil/window damage etc. by controlling the maximum length of time the oscillator is switched on. A short 'on' time, e.g. less than 10 ms, will be indicative of normal working conditions and a longer 'on' time will be indicative of an overload condition (too many counts per second). An overload condition will result in maximum 'on' times, e.g. times of 10 ms, being required.

Alternatively the oscillator can be controlled such that the oscillator is switched on at a regular interval, for example every 100 ms, for a set maximum time period, for example 10 ms. If within the 10 ms the voltage on the dynode stage reaches the required level the oscillator will be switched off, for example after only 6 ms.

When an overload condition is detected this can be indicated on the display or otherwise.

Time delays can also be arranged within the oscillator's switching means. These time delays can be arranged such that whilst an overload condition is indicated the time delay between switching on the oscillator or trying to restart the circuit is gradually increased until the overload condition is removed. These time delays can help protect the photomultiplier tube from the overload conditions thus, for example, preventing 'stripping' of the dynodes if the window is pierced and also allowing for the routine replacement of the window. These delays will also reduce power consumption resulting from the overload condition.

In addition to the advantage of power efficiency and exposure condition detection the above reduces the noise generated in the system whilst the oscillator is off, enabling more accurate readings from the PMT.

The photomultiplier tube circuit according to this invention can be used in any application requiring use of a photomultiplier tube however the circuit according to the present invention has been optimised for use in a radiation monitor. In particular it has been optimised for use in a portable radiation monitor which requires to meet the BASEEFA criteria and which needs no on/off switch, the power efficiency of the circuits resulting in the batteries only requiring replacement annually during planned preventative maintenance and calibration activities, as required under the Ionising Radiation Regulations, 1985.

According to a second aspect of the present invention there is provided a method of controlling the charging of a photomultiplier tube having a plurality of dynodes using a charging means comprising the cycle of:

i/ charging the dynodes to a predetermined voltage;

ii/ switching off the charging means;

iii/ sampling at least one of the dynodes to determine its voltage;

iv/ switching on the charging means when the sampled dynode voltage drops below a predetermined voltage Alternatively there is provided a method of controlling the charging of a photomultiplier tube having a plurality of dynodes using a charging means comprising the cycle of:

i/ switching on the charging means for a predetermined maximum period of time;

ii/ during the predetermined maximum period of time sampling at least one of the dynodes to determine its voltage;

iii/ switching off the charging means when the sampled dynode voltage reaches a predetermined level or the maximum period of time is reached;

iv/ waiting for a predetermined period of time.

Embodiments of the invention will now be described, by way of example, with reference to the accompanying drawing, wherein The FIGURE shows a simplified circuit diagram of the PMT circuit.

Referring to the FIGURE, the PMT circuit comprises a microcontroller, 1; an oscillator circuit, 2, comprising a resistor R1, two capacitors C1 and C2, a transistor TR1 and an inductor L1; charging circuitry in the form of a Cockcroft Walton arrangement, 3, comprising nine diodes, D1 to D9 and nine capacitors C3 to C11; a photomultiplier tube, 4, comprising an anode, dynode stages S1 to S7 and a cathode, and sampling circuitry, 5 comprising resistors R2 and R3 and a comparator.

On start-up the oscillator, 2, provides a high voltage supply to the charging circuitry, 3, which charges the dynode stages of the Photomultiplier tube, 4, until they reach predetermined voltages as determined by the sampling circuitry, 5. In this circuit, only 3 stages of gain are used with dynodes S4 to S7 being connected to the Anode of the photomultiplier tube. When the dynode stages are at the required voltages the sampling circuitry generates a 'stop' signal which is received by the micro-controller, 1, which switches off the oscillator.

During normal operation the oscillator, 2, is switched on every 100 ms by the micro-controller, 1, for a maximum of 10 ms. The charging time required is determined by the micro-controller, 1, using the sampling circuitry, 5. When the sampling circuitry, 5, determines the required voltages have been achieved in the photomultiplier tube, 4, it generates a 'stop' signal and the micro-controller, 1, switches the oscillator, 2, off and determines the total 'on' time.

The 'on' time can then be used to determine exposure conditions, for example a short 'on' time, i.e. one less than 7 ms, will show normal working conditions, a longer 'on' time, i.e. one between 7 ms and 9 ms will indicate 'overload conditions' and an 'on' time of the maximum 10 ms will indicate 'light leak' conditions. Obviously the times taken to indicate the conditions are dependant on the specific components used and voltages required and can be varied accordingly.

When 'overload' or 'light leak' conditions are detected the micro-controller, 1, can be designed so as to wait for increasingly longer set periods of time before switching on the oscillator, 2, again so as to save power and to protect the photomultiplier tube from damage. The time delays between attempting to charge the dynodes could be progressively doubled after a predetermined number of 'on' times which indicate 'overload' or 'light leak' conditions. For example, if after 256 attempts to charge the dynodes the 'overload' or 'light leak' conditions are indicated, the micro-controller, 1, is programmed to wait 2 seconds before trying again to charge the dynodes. If after 256 further attempts to charge the dynodes the 'overload' or 'light leak' conditions are still indicated the micro-controller, 1, is programmed to wait 4 seconds before trying to charge the dynodes. This cycle can be repeated until the 'overload' or 'light leak' conditions are removed. These 'overload' or 'light leak' conditions can also be indicated to a display (not shown).

The invention claimed is:

1. A photomultiplier tube circuit comprising a photomultiplier tube having a plurality of dynodes, charging circuitry for providing charge to the plurality of dynodes and an oscillator for providing a high voltage supply to the charging circuitry characterised in that the photomultiplier tube circuit further comprises means for sampling the voltage of at least one of the dynodes and switching means for switching the oscillator on and off with respect to the at least one dynode voltage sampled.

2. A photomultiplier tube circuit according to claim 1 wherein the switching means comprises a micro-controller.

3. A photomultiplier tube circuit according to claim 1 or 2 wherein the switching means is configured so as to determine the length of time that the oscillator is switched to.

4. A photomultiplier tube circuit according to claim 3 wherein the exposure conditions of the photomultiplier tube can be determined from the length of time that the oscillator is switched on.

5. A photomultiplier tube circuit according to claim 1 wherein the charging circuitry is in the form of a Cockcroft Walton circuit.

6. A photomultiplier tube circuit according to claim 1 wherein the oscillator is switched on for a set period of time at predetermined intervals and is switched off when the dynode voltage sampled reaches a predetermined voltage.

7. A radiation monitor comprising a photomultiplier tube circuit according to claim 1.

8. A photomultiplier tube circuit according to claim 2 wherein the charging circuitry is in the form of a Cockcroft Walton circuit.

9. A photomultiplier tube circuit according to claim 3 wherein the charging circuitry is in the form of a Cockcroft Walton circuit.

10. A photomultiplier tube circuit according to claim 4 wherein the charging circuitry is in the form of a Cockcroft Walton circuit.

11. A photomultiplier tube circuit according to claim 2 wherein the oscillator is switched on for a set period of time at predetermined intervals and is switched off when the dynode voltage sampled reaches a predetermined voltage.

12. A photomultiplier tube circuit according to claim 3 wherein the oscillator is switched on for a set period of time at predetermined intervals and is switched off when the dynode voltage sampled reaches a predetermined voltage.

13. A photomultiplier tube circuit according to claim 4 wherein the oscillator is switched on for a set period of time at predetermined intervals and is switched off when the dynode voltage sampled reaches a predetermined voltage.

14. A radiation monitor comprising a photomultiplier tube circuit according to claim 2.

15. A radiation monitor comprising a photomultiplier tube circuit according to claim 3.

16. A radiation monitor comprising a photomultiplier tube circuit according to claim 4.

* * * * *